US006000869A

United States Patent [19]

Lee

[11] Patent Number: 6,000,869

[45] Date of Patent: Dec. 14, 1999

[54] TECHNIQUE FOR CONTROLLING THE POSITION OF A DRIVING MOTOR AND A PRINT HEAD

[75] Inventor: Sung-Hee Lee, Kyonggi-do, Rep. of Korea

[73] Assignee: SamSung Electronics Co., Ltd., Suwon, Rep. of Korea

[21] Appl. No.: 08/879,194

[22] Filed: Jun. 19, 1997

[30] Foreign Application Priority Data

Jun. 20, 1996 [KR] Rep. of Korea ..... 22591

[51] Int. Cl.[6] ..... B41J 21/16

[52] U.S. Cl. ..... 400/279; 400/174; 400/175

[58] Field of Search ..... 400/174, 175, 400/279, 320, 322, 323, 903

[56] References Cited

U.S. PATENT DOCUMENTS

| | | | |
|---|---|---|---|
| 4,741,634 | 5/1988 | Nazaki | 400/279 |
| 4,755,070 | 7/1988 | Cerutti | 400/320 |
| 4,897,589 | 1/1990 | Fujiwara | 400/903 |
| 5,245,359 | 9/1993 | Ito et al. | 346/139 R |
| 5,312,193 | 5/1994 | Kringe | 400/322 |
| 5,416,395 | 5/1995 | Hiramatsu et al. | 318/600 |
| 5,427,461 | 6/1995 | Hirai et al. | 400/279 |
| 5,485,178 | 1/1996 | Tateyama et al. | 347/5 |
| 5,527,121 | 6/1996 | Santon | 400/323 |
| 5,541,508 | 7/1996 | Suzuki | 324/207.21 |
| 5,547,295 | 8/1996 | Kanemitsu | 400/279 |
| 5,873,663 | 2/1999 | Yokoi et al. | 400/279 |

FOREIGN PATENT DOCUMENTS

| | | | |
|---|---|---|---|
| 62-16096 | 1/1987 | Japan | 400/320 |
| 63-11376 | 1/1988 | Japan | 400/320 |
| 5-270110 | 10/1993 | Japan | 400/320 |
| 5-278279 | 10/1993 | Japan | 400/320 |

*Primary Examiner*—Edgar Burr
*Assistant Examiner*—Charles H. Nolan, Jr.
*Attorney, Agent, or Firm*—Robert E. Bushnell, Esq.

[57] ABSTRACT

A device for accurately controlling the positions of a driving motor and a print head and enhancing print quality by sensing the position of the driving motor by occurring pulses from a timer at shorter intervals than predetermined step units and synchronously driving the print head with control of the driving motor, includes a synchronizing pulse generator for generating high speed synchronizing pulses for controlling the position of the driving motor and the print head, a position controller for synchronously controlling the position of the driving motor with divided generated pulses, a print head controller for synchronously controlling the position of the print head with the divided generated pulse, an interrupt controller for receiving interrupt signals generated in the position controller during the acceleration and deceleration of the driving motor and for generating interrupt in the priority order, and a CPU (central processing unit) for generating interrupts according to interrupt request signals, setting time in the generator, outputting signals for controlling the driving motor according to the set time during the acceleration and deceleration periods and governing all the component blocks.

28 Claims, 4 Drawing Sheets

TECHNIQUE FOR CONTROLLING THE POSITION OF A DRIVING MOTOR AND A PRINT HEAD

CLAIM OF PRIORITY

This application makes reference to, incorporates the same herein, and claims all benefits accruing under 35 U.S.C. §119 from an application for METHOD AND DEVICE FOR CONTROLLING THE POSITIONS OF A DRIVING MOTOR AND A PRINT HEAD earlier filed in the Korean Industrial Property Office on Jun. 20, 1996 and there duly assigned Ser. No. 22591/1996, a copy of which application is annexed hereto.

BACKGROUND OF THE INVENTION

1. Field of the Invention

The present invention relates to a technique for controlling the position of a driving motor (e.g. a step motor) and a print head. More specifically, the invention relates to a position control technique for accurately controlling the position of a driving motor by generating timer pulses at shorter intervals than step units, and for enhancing print quality by synchronizing the drive of the print head with the control of the driving motor.

2. Description of the Related Art

An earlier position controlling device for driving motor and a print head includes a position controller for controlling the position of the driving motor by supplying the driving motor with pulse signals resulting from an interrupt, a print controller for controlling the drive of the print head by supplying the print head with pulse signals, and a central processing unit for generating interrupt signals to drive the driving motor and the print head according to interrupt request signals generated by the position controller and the print controller and governing all of the component blocks in the controllers.

The position controller includes a first timer for generating pulses at fixed intervals, a first interrupt generator for generating drive motor interrupt signals according to the pulse signals from the first timer, a control circuit for receiving the driving motor interrupt signals from the first interrupt generator and for generating corresponding interrupt request signals in a predetermined priority order and transmitting the interrupt request signals to the central processing unit, a first buffer for temporarily storing driving motor drive signals from the central processing unit, and a fire drive circuit for moving a carriage having the print head attached thereto to a desired position by controlling the driving motor according to the signals stored in the first buffer.

The print controller includes a second timer for generating pulses at fixed intervals, a second interrupt generator for generating print head interrupt signals according to the pulse signals from the second timer, the control circuit for receiving the print head interrupt signals from the second interrupt generator and for generating corresponding interrupt request signals in a predetermined priority order and transmitting the interrupt request signals to the central processing unit, a second buffer for temporarily storing print head nozzle drive signals from the central processing unit, and a second drive circuit for driving the nozzle of the print head by reading the signals stored in the second buffer to perform a printing job.

The position of the driving motor is controlled as follows. The time for one step of the driving motor is fixed in the first timer so that the first timer can output pulse signals at fixed times.

The first interrupt generator, which has received the pulse signals from the first timer, outputs interrupt signals corresponding to the pulse signals and is enabled or disabled depending on control signals from the central processing unit.

When the first interrupt generator is enabled, the pulse signals from the first timer are inputted to the control circuit via the first interrupt generator and are supplied to an interrupt terminal of the central processing unit to require an interrupt in the predetermined interrupt priority order.

The central processing unit, which received the interrupt request signals, generates an interrupt to transmit control signals for controlling the position of the driving motor to the first buffer. By data stored in the first buffer, the first drive circuit drives the driving motor and consequently, the carriage having the print head attached thereto moves.

The method in which the position of the print head is controlled is similar to the method for controlling the driving motor.

The time for moving the print head is fixed in the second timer so that the second timer can output pulse signals at fixed times.

The second interrupt generator which received the pulse signals from the second timer outputs interrupt signals to the control circuit and is enabled or disabled depending on control signals from the central processing unit.

The control circuit, which received the interrupt signals, transmits the interrupt signals received in a priority order to the central processing unit to require an interrupt.

The central processing unit, which received the interrupt signals, generates an interrupt and outputs signals for operating the print head to the second buffer.

The data stored in the second buffer is transmitted to move the print head via the second drive circuit, whereby the nozzles of the print head operate to perform a printing job.

In short, the central processing unit generates an interrupt by the interrupt request signals which are generated depending on the fixed times in the timers. Then, the driving motor and the print head are controlled to perform the printing job.

However, the earlier position controller for a driving motor and a print head has several problems. Whenever the driving motor and the print head drive, interrupts are required. In addition, two times need to be fixed in the two respective timers. One time is for the next step of the driving motor and the other time is for driving the print head. This results in an overload in the CPU during high-speed driving. An increased cost and limited control are other defects. The position of the driving motor is calculated only by the interrupt occurrence and is controlled by the step units thereof.

Accordingly, for more accurate control, a costly precise motor is required.

Furthermore, the limitation of the step angle prevents the controlling of the motor by a smaller step unit.

The following patents each disclose features in common with the present invention but do not teach or suggest the specifically recited technique for controlling the position of a driving motor and a print head in accordance with the present invention:

U.S. Pat. No. 5,527,121 to Santon, entitled Printhead Carriage Control Method And Apparatus For Achieving Increased Printer Throughput, U.S. Pat. No. 5,541,508 to Suzuki, entitled Position Detector For Synchronizing Operation Of A Recording Device With That Of A Carriage In A Recording Apparatus, U.S. Pat. No. 5,547,295 to Kanemitsu, entitled Carriage Driving Method And Apparatus For Efficiently Accelerating To A Constant Speed, U.S. Pat. No. 5,416,395 to Hiramatsu et al., entitled Carriage Drive Control For A Printer, U.S. Pat. No. 5,427,461 to Hirai et al., entitled Serial Printer With Carriage Position Control, U.S. Pat. No. 5,485,178 to Tateyama et al., entitled Printer Control Apparatus For Synchronously Controlling Driving Of Recording Head And Transfer Of Data, and U.S. Pat. No. 5,245,359 to Ito et al., entitled Recording Apparatus With Recording Head Carriage Driving Motor Control.

SUMMARY OF THE INVENTION

It is therefore an object of the present invention to provide a controller which is capable of: (1) reducing the load of the CPU by means of controlling the output of pulse signals in the manner that the pulse signals are outputted by a timer having an auto-load function at regular intervals during the driving motor's regular-speed driving, while during the driving motor's acceleration/deceleration driving, the pulse signals are generated depending on the newly fixed time according to the interrupt occurrence; (2) more accurately controlling the position of the driving motor by means of counting the position of the driving motor at that time with a position sensor which is a timer for controlling step time; and (3) enhancing the print quality by means of driving the print head synchronously with the driving motor position control as above.

To achieve the object, the invention controls the driving motor according to three periods divided by the driving speed thereof, i.e. an acceleration period, uniform speed period and a deceleration period, and includes a counter which drives synchronously with high-speed pulse signals, thereby making it possible to accurately control the position of the driving motor. As a result, it is also possible to enhance the print quality.

The above object is achieved through a method including steps of: setting a control value in a means for setting the number of pulses and a pulse generator according to the type of driving motor; driving a synchronizing pulse generator and a first scaler according to the time values for moving one step, fixed in the synchronous pulse generator and the first scaler respectively; moving a counter up/down relative to rotating direction of the driving motor; and controlling the driving motor and the print head.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
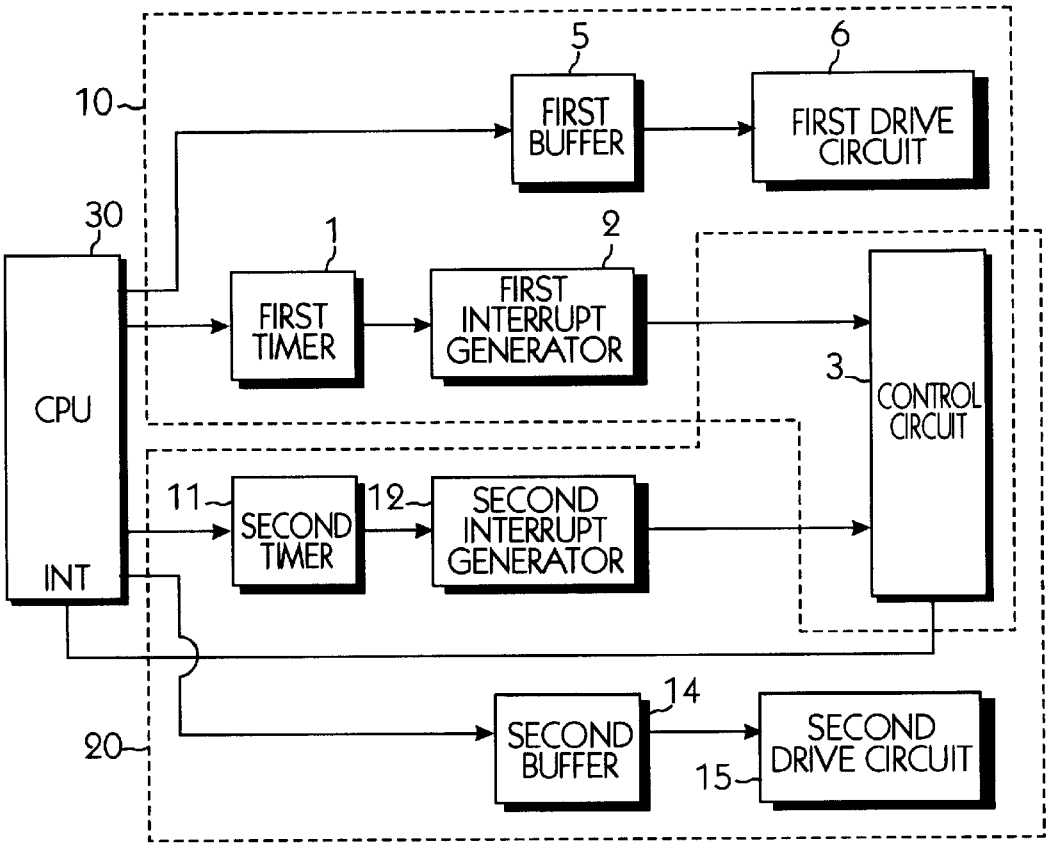
FIG. 1 is a schematic block diagram of an earlier position controller for a driving motor and a print head.

Referring to FIG. 1, an earlier position controlling device for a driving motor (not shown) and a print head (not shown) includes: a position controller 10 for controlling the position of the driving motor by supplying the driving motor with pulse signals resulting from an interrupt; a print controller 20 for controlling the drive of the print head by supplying the print head with pulse signals; and a CPU (Central Processing Unit) 30 for (1) generating interrupt signals to drive the driving motor and the print head, according to interrupt request signals generated by the position controller 10 and the print controller 20, and (2) governing all of the component blocks in the controller.

The position controller 10 includes: a first timer 1 for generating pulses at fixed intervals; a first interrupt generator 2 for generating driving motor interrupt signals according to the pulse signals from the first timer 1; a control circuit 3 for receiving the driving motor interrupt signals from the first interrupt generator 2 and for generating corresponding interrupt request signals in a predetermined priority order and transmitting the interrupt request signals to the CPU 30; a first buffer 5 for temporarily storing driving motor drive signals from the CPU 30; and a first drive circuit 6 for moving a carriage (not shown) having the print head attached thereto to a desired position by controlling the driving motor according to the signals stored in the first buffer 5.

The print controller 20 includes: a second timer 11 for generating pulses at fixed intervals; a second interrupt generator 12 for generating print head interrupt signals according to the pulse signals from the second timer 11; the control circuit 3 for receiving the print head interrupt signals from the second interrupt generator 12 and for generating corresponding interrupt request signals in a predetermined priority order and transmitting the interrupt request signals to the CPU 30; a second buffer 14 for temporarily storing print head nozzle drive signals from the CPU 30; and a second drive circuit 15 for driving the nozzle of the print head by reading the signals stored in the second buffer 14 to perform a printing job.

The position of the driving motor is controlled as follows. The time for one step of the driving motor is fixed in the first timer 1 so that the first timer 1 can output pulse signals at fixed times.

The first interrupt generator 2, which has received the pulse signals from the first timer 1, outputs interrupt signals corresponding to the pulse signals and is enabled or disabled depending on control signals from the CPU 30.

When the first interrupt generator 2 is enabled, the pulse signals from the first timer 1 are inputted to the control circuit 3 via the first interrupt generator 2, and are supplied to an interrupt terminal INT of the CPU 30 to require an interrupt in the predetermined interrupt priority order.

The CPU 30, which received the interrupt request signals generates an interrupt to transmit control signals for controlling the position of the driving motor to the first buffer 5. By data stored in the first buffer 5, the first drive circuit 6 drives the driving motor. Consequently, the carriage (not shown) having the print head attached thereto moves.

The method in which the position of the print head is controlled is similar to the method for controlling the driving motor.

The time for moving the print head is fixed in the second timer 11 so that the second timer 11 can output a pulse signal at fixed times.

The second interrupt generator 12 which received the pulse signals from the second timer 11 outputs interrupt signals to the control circuit 3, and is enabled or disabled depending on control signals from the CPU 30.

The control circuit 3, which received the interrupt signals, transmits the interrupt signals received in an interrupt priority order to the CPU 30 to require an interrupt.

The CPU 30, which received the interrupt signals, generates an interrupt and outputs signals for operating the print head to the second buffer 14.

The data stored in the second buffer 14 is transmitted to move the print head via the second drive circuit 15, whereby the nozzles of the print head operate to perform a printing job.

In short, the CPU 30 generates an interrupt by the interrupt request signals which are generated depending on the fixed times in the timers 1 and 11. Then, the driving motor and the print head are controlled to perform the printing job.

Figure 2:
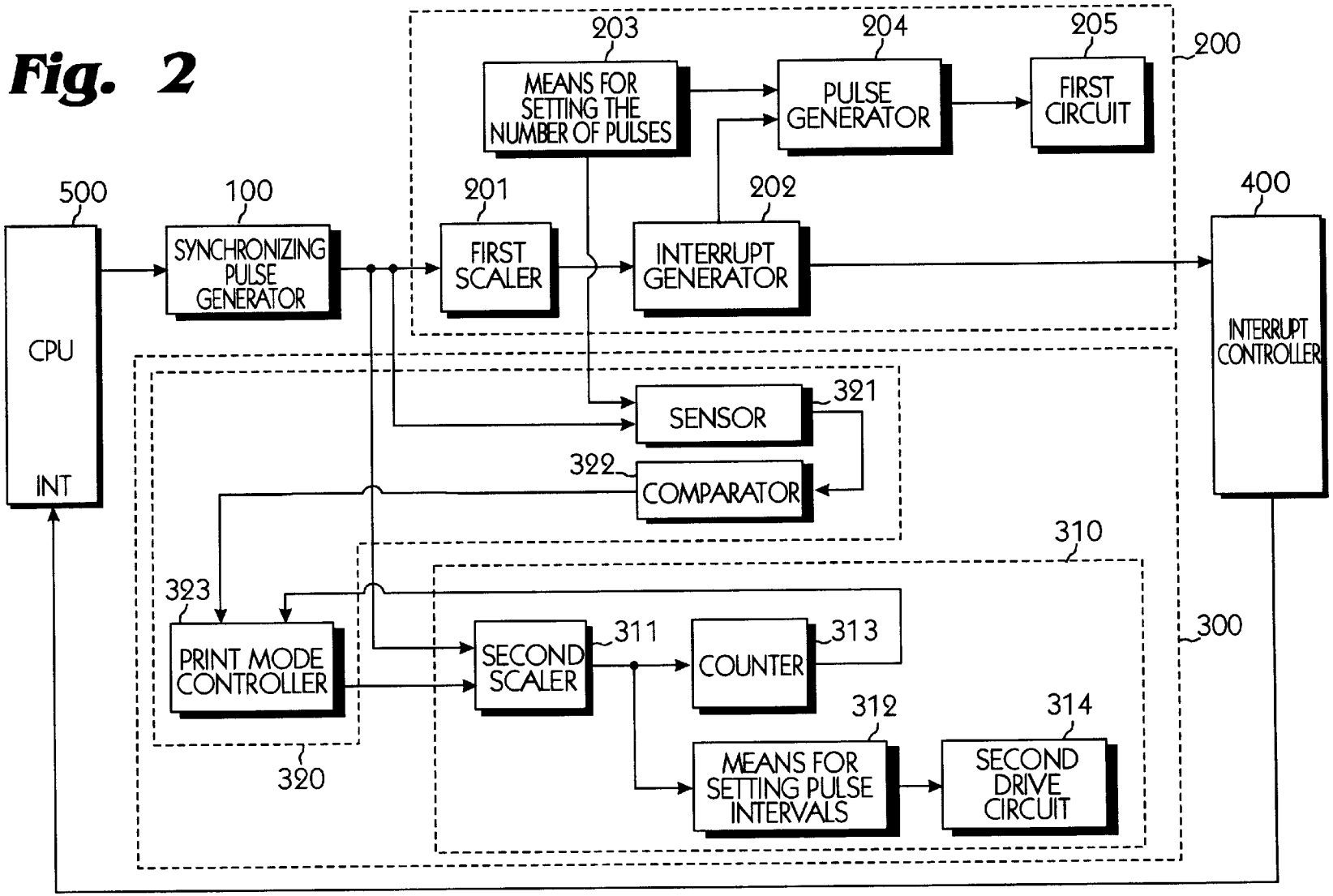
FIG. 2 is a schematic block diagram of a position controller for a driving motor and a print head according to the present invention.

Referring to FIG. 2, the position controller of the invention includes: a synchronizing pulse generator 100 for generating high-speed synchronizing pulse signals for controlling the position of the driving motor and the print head; a position controller 200 for controlling the position of the driving motor by synchronizing the position control with the divided pulse signals from the synchronizing pulse generator 100; a print head controller 300 for controlling the position of the print head by synchronizing the position control with the divided pulse signals from the synchronizing pulse generator 100; an interrupt controller 400 for receiving interrupt occurrence signals from the position controller 200 on acceleration/deceleration of the driving motor and for generating interrupts in an interrupt priority order; and a CPU 500 for generating interrupts according to interrupt request signals from the interrupt controller 400, setting time in the synchronizing pulse generator 100, outputting signals for driving the driving motor on acceleration/deceleration of the driving motor according to the set time and governing all the component blocks.

The position controller 200 includes: a first programmable scaler 201 for generating pulse signals for driving the driving motor with the divided high-speed pulses from the synchronizing pulse generator 100; an interrupt generator 202 for generating driving motor drive signals during the uniform speed period and generating a step interrupt during the acceleration/deceleration periods; a means for setting the number of pulses, for example, a register, RAM (random access memory) or ROM read only memory) 203 where the CPU 500 set values for the drive mode, excitation mode and rotating direction of the driving motor; a pulse generator 204 for generating driving motor drive pulses according to the signals from the interrupt generator 202 and the means for setting the number of pulses 203; and a first circuit 205 for driving the driving motor according to the pulse signals from the pulse generator 204.

The print head controller 300 includes: a programmable voltage generator 310 for dividing the high-frequency pulses from the synchronizing pulse generator 100 to generate pulse signals, and for generating a voltage for driving the print head; and a voltage controller 320 for enabling/disabling the voltage generator 310 by synchronizing with the high-frequency pulse signals from the synchronizing pulse generator 100.

The voltage controller 320 includes: a sensor 321 for synchronously counting the position of the driving motor with the high-speed pulse signals from the synchronizing pulse generator 100; a comparator 322 for comparing the position of the driving motor and the position to be printed; and a print mode controller 323 for enabling the voltage generator 310 and setting print mode when the correspondence between the two positions is confirmed by the comparator 322.

The voltage generator 310 includes: a second scaler 311 for dividing the high speed pulse signals from the synchronizing pulse generator 100 and for generating a voltage for driving a nozzle according to the DPI (Dots Per Inch) set in the print mode controller 323; a means for setting pulse intervals 312 for synchronously driving the nozzle with the pulse signals from the second scaler 311; a counter 313 for synchronously counting the columns to be printed with the pulse signals from the second scaler 311 and for disabling the signals for driving the nozzle by sending signals indicating the completion of a printing job to the print mode controller 323; and a second drive circuit 314 for driving the nozzle of the print head for the amount of the time determined by the means for setting pulse intervals 312.

Figure 3:
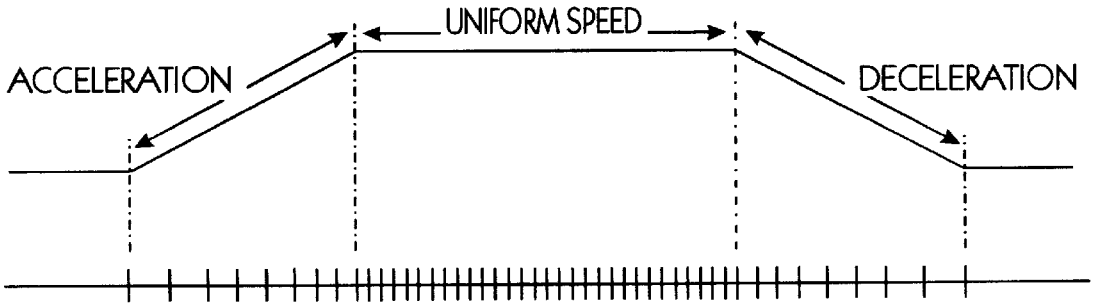
FIG. 3 is a timing chart of interrupt occurrence in three periods, i.e. an acceleration period, an uniform speed period and a deceleration period.

As shown in FIG. 3, the driving motor's operation to move the print head installed in a carriage (not shown) to the position to be printed is accomplished through three periods. They are an acceleration period, a uniform speed period and a deceleration period. During the acceleration period, the driving motor is accelerated to a fixed rotating speed level. The fixed speed is maintained for an amount of time sufficient to perform a printing job. This is the uniform speed period. Upon completion of the printing job, there is a deceleration period for stopping the driving motor.

Accordingly, the synchronizing pulse generator 100 produces high-speed synchronous pulses which become a standard for controlling the driving motor relative to the three periods and for controlling the print head which synchronizes with the driving motor.

During the uniform speed period, the first scaler 201 which received the high-speed pulses from the synchronizing pulse generator 100 divides the pulses according to a predetermined program to continuously output step pulses for moving the driving motor by one step at every fixed interval and sets the time for the fixed interval in the synchronizing pulse generator 100 using the function of auto load, thereby causing the generator to produce step pulses at fixed intervals.

The pulses generated at regular intervals in the first scaler 201 are transmitted to the interrupt generator 202, which is enabled by a control signal from the CPU 500 and outputs trigger signals.

According to the trigger signal, the pulse generator 204 produces signals for driving the driving motor at the fixed intervals. Then, the first circuit 205 is driven by the signals and it is possible to control the driving motor to rotate at the uniform speed.

In other words, during the uniform speed period, the driving motor's drive is not by the interrupt from the CPU 500, but by the uniform pulse signals from the pulse generator 204.

During the periods of acceleration and deceleration, the interrupt is not produced at uniform intervals. First in the acceleration period, the intervals between the interrupt occurrences are long and get shorter by degree. This results in an acceleration of the driving motor. On the other hand, the intervals get longer and longer in the deceleration period until the driving motor stops.

Therefore, the method to control the driving motor's drive in the periods of acceleration and deceleration are similar to earlier methods. By the interrupts occurring according to the interrupt request signals from the interrupt controller 400, the CPU 500 keeps setting newly varied time values in the synchronizing pulse generator 100 to control the driving motor.

The print head is synchronously controlled with the control of the driving motor, i.e. with the high-frequency synchronizing pulses from the synchronizing pulse generator 100.

In other words, by synchronously driving the counter of the sensor 321 with the high-frequency pulse signals from the generator 100, the driving motor which operates at a lower pulse rate than the synchronizing pulses can be more accurately controlled. The comparator 322 confirms the correspondence between the driving motor's position checked in the sensor 321 and the position to be printed. When the two positions meet at a point, the print mode controller 323 enables the voltage generator 310, followed by the print head driving to perform the printing job.

Accordingly, the second scaler 311 of the voltage generator 310 enabled by the print mode controller 323 divides the high speed synchronizing pulse from the synchronizing pulse generator 100 and supplies each nozzle with voltage at the amount of DPI predetermined by the print mode controller 323.

At this time, the counter 313 counts the number of the columns to be printed. When the printing is completed, the counter 313 transmits signals for indicating the completion of the printing job to the print mode controller 323.

This results in disablement of the operation of the voltage generator 310.

The means for setting pulse intervals 312 sets the pulse intervals in which the nozzle of the second drive circuit 314 is able to operate to perform the printing job.

Figure 4A:
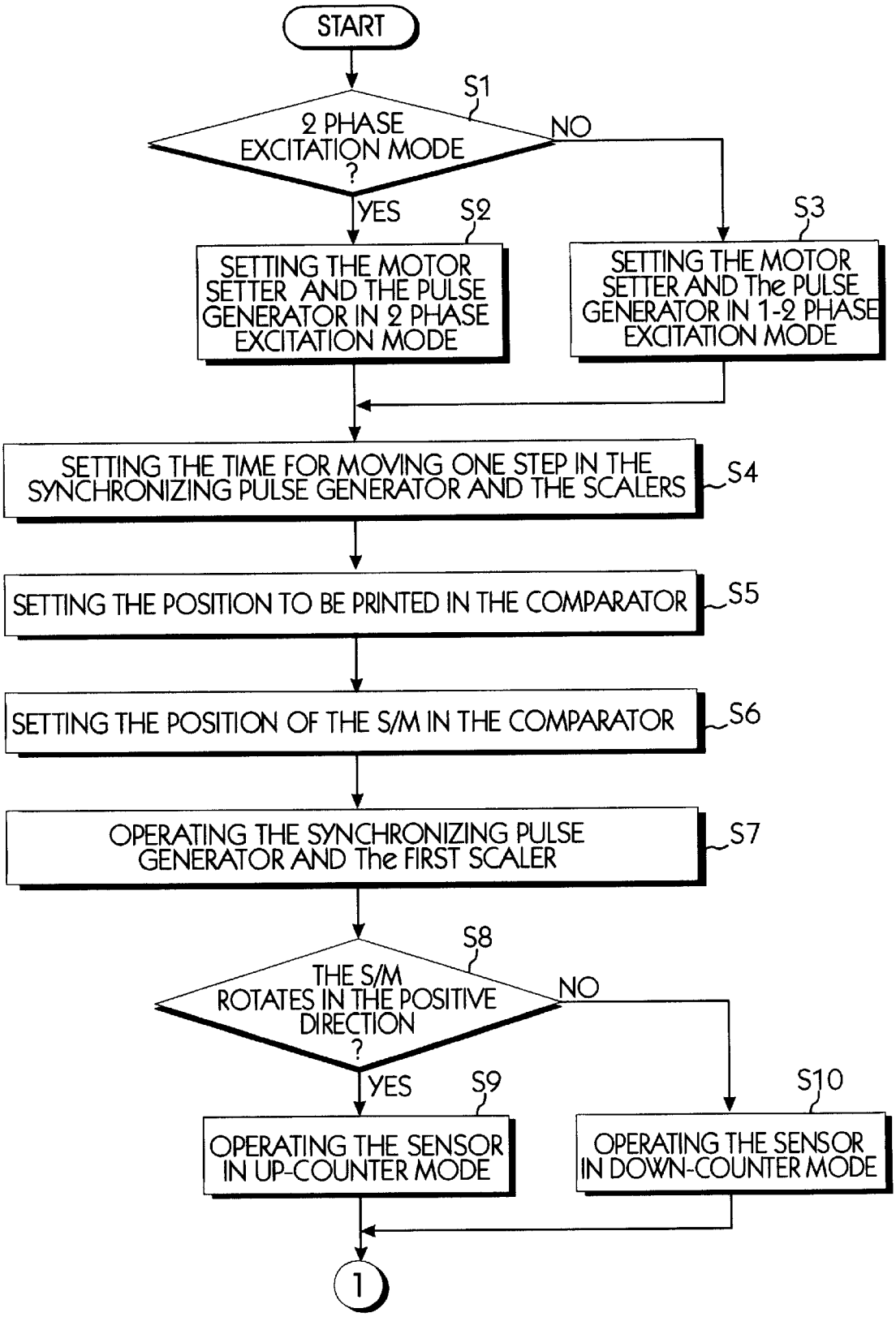
FIGS. 4A–4B together form a flowchart for illustrating the technique for controlling the position of the driving motor and the print head according to the present invention.
Figure 4B:
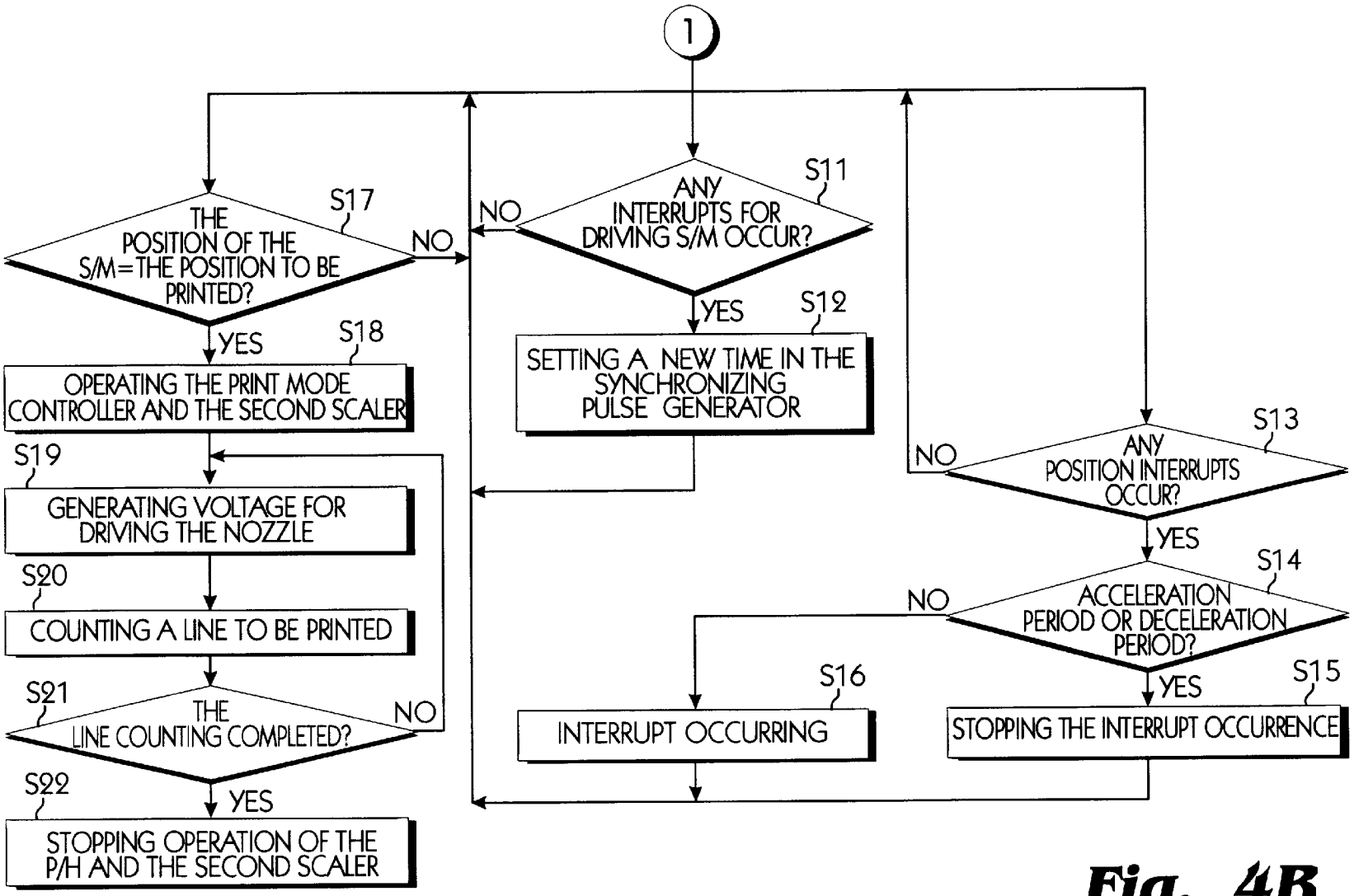

The operation of the invention will be apparent from the following description with reference to FIGS. 4A–4B.

When the driving motor is in a 2 phase excitation mode, the means for setting the number of pulses 203 and the pulse generator 204 are set in the 2 phase excitation mode. When the driving motor is in a 1–2 phase excitation mode, the means for setting the number of pulses 203 and the pulse generator 204 are set in the 1–2 phase excitation mode. This is shown as steps S1 to S3.

The time for generating the high speed synchronizing pulses is set in the synchronizing pulse generator 100. Then the scalers 201 and 311 outputs pulses for moving one step after the set time passed. This is the step S4.

After the time set, the position of the driving motor and the position to be printed are set in the comparator 322 and the synchronizing pulse generator 100 and the first scaler 201 operates. This is the steps S5 to S7.

Then, the sensor 321 operates in an up-counter mode when the driving motor rotates in the positive direction while the sensor 321 operates in a down-counter mode when the driving motor rotates in the negative direction. This is the steps S8 to S10.

When an interrupt is generated in the interrupt generator 202, the driving motor is driven according to the interrupt. Then, a new time is set in the synchronizing pulse generator 100. This is shown as the steps S11 and S12.

When the position interrupt occurs, the rotating state of the driving motor, i.e. whether it is in the acceleration period or in the deceleration period is determined. If the rotating state of the driving motor is not in either of the periods, the fact that the driving motor rotates at a uniform speed is output to the CPU 500 and the driving motor drives according to the interrupt signals occurrence. This is the steps S13 to S16.

If the rotating state of the driving motor is in the acceleration period or the deceleration period, the operation of the interrupt generator is stopped and interrupt request signals are transmitted to the CPU 500 to control the driving motor. This is the steps S13 to S15.

After determining the correspondence between the position of the driving motor and the position to be printed, the print mode controller 323 and the second scaler 311 operate. This is the step S17 and the step S18.

In the step S18, when the second scaler 311 operates, a voltage for driving the nozzle occurs and a line to be printed is counted. Upon completion of printing the line, the print mode controller 323 stops operating. This is the steps S19 to S21.

The controller according to the present invention is capable of: minimizing the load of the CPU by means of driving the driving motor not only by the interrupt occurrence in the CPU, but also by the control signals from the pulse generator; and more accurately controlling the position of the driving motor by means of using a counter synchronized with higher frequency pulses than the driving motor drive pulses.

It should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. A device for controlling the position of a driving motor and a print head comprising:

a synchronizing pulse generator for generating synchronizing pulses to control the position of the driving motor and the print head;

a position controller for generating first divided synchronizing pulses by dividing said synchronizing pulses generated by said synchronizing pulse generator, and synchronously controlling the position of the driving motor with said first divided synchronizing pulses;

a print head controller for generating second divided synchronizing pulses by dividing said synchronizing pulses generated by said synchronizing pulse generator, and synchronously controlling the position of the print head with said second divided synchronizing pulses;

a control circuit for generating interrupt signals in a priority order corresponding to interrupt requiring request signals which are generated by said position controller while the driving motor accelerates or decelerates in its rotation; and a central processing unit for setting time values corresponding to said interrupt signals from said control circuit, outputting signals for driving the driving motor corresponding to said time values while the driving motor accelerates or decelerates its rotation, and controlling said components.

2. The device of claim 1, said position controller comprising:

a first scaler for generating pulse signals to drive the driving motor by dividing the pulses generated in said synchronizing pulse generator;

an interrupt signal generator for generating signals to drive the driving motor while the driving motor rotates at a uniform speed, and generating step interrupt signals while the driving motor accelerates or decelerates in its rotation;

a driving motor setting means in which said central processing unit sets a value corresponding to an excitation mode of the driving motor;

a pulse generator for generating pulses to drive the driving motor according to said signals from said interrupt signal generator and said signals from said driving motor setting means; and a first control circuit for driving the driving motor according to the pulse signals from said pulse generator.

3. The device of claim 1, said print head controller comprising:

a voltage generator for generating pulse signals by dividing the pulses from said synchronizing pulse generator, and for generating a voltage for driving the print head; and a voltage controller for controlling the voltage generator by synchronizing with the pulses from said synchronizing pulse generator.

4. The device of claim 3, said voltage controller comprising:

a sensor for synchronously counting the position of the driving motor with the pulse signals from said synchronizing pulse generator;

a comparator for comparing the position of the driving motor sensed by said sensor and the position to be printed; and a print mode controller for controlling said voltage generator according to the result from said comparator.

5. The device of claim 3, said voltage generator comprising:

a second scaler for generating voltage for driving nozzle according to the print mode set by said print mode controller by dividing the pulse signals from said synchronizing pulse generator;

a means for setting pulse intervals for synchronously driving the nozzle with said pulse signals from said second scaler;

a counter for synchronously counting the columns to be printed with the pulse signals from said second scaler and disabling the signals for driving the nozzle by sending signals indicating the completion of printing job to said print mode controller; and a second drive circuit for driving the nozzle of the print head for the amount of the time determined by said means for setting pulse intervals.

6. The device of claim 1, said control circuit generating interrupt signals only during the acceleration/deceleration of the driving motor.

7. The device of claim 1, said synchronizing pulse generator generating pulses having a higher frequency than that of the pulses for driving the driving motor and the pulses for driving the print head.

8. The device of claim 1, said driving motor being a step motor.

9. A method of controlling the position of a driving motor and a print head comprising the steps of:

setting a control value in a means for setting a number of pulses and a pulse generator according to an excitation mode of the driving motor;

setting a time value for driving said pulse generator and a first scaler;

moving a counter up or down relative to a rotating direction of the driving motor; and controlling the driving motor and the print head.

10. The method of claim 9, said control value setting step comprising the steps of:

setting said means for setting a number of pulses and said pulse generator in a 2 phase excitation mode when the driving motor is in a 2 phase excitation mode; and setting said means for setting a number of pulses and said pulse generator in a 1–2 phase excitation mode when the driving motor is in a 1–2 phase excitation mode.

11. The method of claim 9, said time value setting step comprising the steps of:

setting the time value in said pulse generator, said first scaler and a second scaler for moving one step; and driving said pulse generator and said first scaler after setting the position value for the driving motor and for performing a printing job.

12. The method of claim 9, said counter moving step comprising the steps of:

operating a sensor in an up-counter mode when the driving motor rotates in a positive direction; and operating said sensor in a down-counter mode when the driving motor rotates in a negative direction.

13. The method of claim 9, said controlling step comprising the steps of:

controlling the drive of the driving motor according to the operation of a counter; and synchronously controlling the print head with the drive of the driving motor.

14. The method of claim 13, said driving motor controlling step comprising the steps of:

driving the driving motor according to an interrupt occurrence during acceleration and deceleration periods of the driving motor; and driving the driving motor according to the operation of said pulse generator during a uniform speed period of the driving motor.

15. The method of claim 13, said print head controlling step comprising the steps of:

driving said print mode controller and said second scaler when a position of the driving motor and a position to be printed correspond;

performing printing a job by generating voltage for driving a nozzle according to the operation of said print mode controller and said second scaler;

counting a line to be printed according to the process of the printing job; and stopping the operation of said print mode controller and said second scaler upon completion of printing the line.

16. The method of claim 9, further comprising providing a step motor as said driving motor.

17. The device of claim 2, said driving motor being a step motor.

18. The device of claim 3, said driving motor being a step motor.

19. The device of claim 4, said driving motor being a step motor.

20. The device of claim 5, said driving motor being a step motor.

21. The device of claim 6, said driving motor being a step motor.

22. The device of claim 7, said driving motor being a step motor.

23. The method of claim 10, further comprising providing a step motor as said driving motor.

24. The method of claim 11, further comprising providing a step motor as said driving motor.

25. The method of claim 12, further comprising providing a step motor as said driving motor.

26. The method of claim 13, further comprising providing a step motor as said driving motor.

27. The method of claim 14, further comprising providing a step motor as said driving motor.

28. The method of claim 15, further comprising providing a step motor as said driving motor.

* * * * *